US006019608A

United States Patent [19]

Stark

[11] Patent Number: 6,019,608

[45] Date of Patent: Feb. 1, 2000

[54] SNOWBOARD TRAINING APPARATUS

[76] Inventor: Jon Stark, 155 N. Benson Ave., Upland, Calif. 91786

[21] Appl. No.: 09/191,699

[22] Filed: Nov. 13, 1998

Related U.S. Application Data

[63] Continuation-in-part of application No. 09/189,097, Nov. 9, 1998, abandoned.

[51] Int. Cl.[7] ..... A63B 69/18

[52] U.S. Cl. ..... 434/253; 482/71

[58] Field of Search ..... 434/247, 250, 434/253; 482/124, 110, 43, 71; 446/26, 28; 273/DIG. 19

[56] References Cited

U.S. PATENT DOCUMENTS

| | | |
|---|---|---|
| 2,496,748 | 2/1950 | Pond . |
| 3,006,645 | 10/1961 | Frazier . |
| 3,051,482 | 8/1962 | Harpham . |
| 3,425,690 | 2/1969 | Charbonnet . |
| 3,432,163 | 3/1969 | Murphy . |
| 3,532,340 | 10/1970 | Nardiello . |
| 4,424,040 | 1/1984 | Buchheister et al. . |
| 4,505,681 | 3/1985 | Jones . |
| 5,074,795 | 12/1991 | Clark . |
| 5,120,227 | 6/1992 | Born . |
| 5,192,258 | 3/1993 | Keller . |
| 5,226,820 | 7/1993 | Pearson . |
| 5,312,258 | 5/1994 | Giorgio . |
| 5,360,384 | 11/1994 | Toensing . |
| 5,378,156 | 1/1995 | Rohe . |
| 5,601,434 | 2/1997 | Winters . |

FOREIGN PATENT DOCUMENTS 1428391 10/1988 U.S.S.R. .

*Primary Examiner*—Kien T. Nguyen
*Attorney, Agent, or Firm*—Sheldon & Mak; Denton L. Anderson

[57] ABSTRACT

A snowboard training device is provided which allows a an instructor to direct the movement of a snowboard trainee from a reasonable distance. The snowboard training device includes an inner member suitable for attaching firmly to the mid-section of the trainee, a rigid outer member disposed spaced apart from the mid-section of the trainee, and at least one connecting member which acts to fixedly attach the inner member to the outer member in a horizontal disposition. The snowboard training device further includes an elliptical hoop or other rigid device fixedly attached to a harness worn by the snowboard trainee and which extends horizontally about the mid-section of the trainee at a distance that allows an instructor to direct the movement of the trainee while the snowboard trainee is snowboarding on a snow slope.

20 Claims, 1 Drawing Sheet

SNOWBOARD TRAINING APPARATUS

This is a continuation-in-part of U.S. patent application Ser. No. 09/189,097 (abandoned), entitled Snowboard Training Apparatus, filed on Nov. 9, 1998. By this reference, this application incorporates the entirety of U.S. patent application Ser. No. 09/189,097 as if set forth fully herein.

FIELD OF THE INVENTION

This invention relates generally to skiing and snowboard equipment and methods, and more specifically, to skiing and snowboard training equipment and methods.

BACKGROUND OF THE INVENTION

Snowboarding is a relatively new sport, the popularity of which increased dramatically in the 1990's. Unfortunately, snowboarding requires many subtle body movements on the part of the rider which can be a difficult to learn. For example, the snowboard riders hip movements indirectly effect the disposition of the riders torso, the riders center of gravity, the placement of the riders legs, and the ankle movements of the rider, all of which are important in snowboarding. Learning how to appropriately twist and turn ones hips is also critical in having a snowboard form an edge in the snow in order to control the snowboard and make turns.

In practice, teaching a person how to ride a snowboard through description or demonstration alone is of limited utility. A more effective method of teaching snowboarding is to allow a snowboard rider to experience the effect their body movements have on the control of a snowboard on an actual snow slope. Demonstrating effective body placement and movement is best accomplished by having an instructor direct the body movements of the trainee while the trainee is attempting to snowboard. Unfortunately, this is difficult to accomplish because it requires that an instructor accompany the trainee on a snow slope at a distance which both allows the trainee to attempt to independently snowboard and also permits an instructor to physically direct the movements of the snowboard trainee.

Accordingly, there is a need for a device which allows an instructor to direct the movement of a snowboard trainee at a substantial distance while the trainee is snowboarding on a snow slope.

SUMMARY

The invention satisfies this need. The invention is a snowboard training device and method of using such a device. The invention comprises a snowboard training device adapted to enable an instructor to direct the movement of a snowboard trainee from a substantial distance, the snowboard training device comprising an inner member suitable for attaching firmly to the mid-section of the trainee, a rigid outer member disposed spaced apart from the mid-section of the trainee at a distance not less than about 12 inches from the mid-section of the trainee, and at least one connecting member which acts to fixedly attach the inner member to the outer member in a horizontal disposition.

In one preferred embodiment, the invention is comprised of a substantially elliptical hoop fixedly attached to a harness worn by the snowboard trainee. The substantially elliptical hoop extends horizontally about the mid-section of the trainee at a distance that allows an instructor to move the substantially elliptical hoop, and thus direct the movement of the trainee while the snowboard trainee is snowboarding on a snow slope.

DRAWINGS

These features, aspects and advantages of the present invention will become better understood with regard to the following description, appended claims and accompanying figures where:

DETAILED DESCRIPTION

Figure 1:
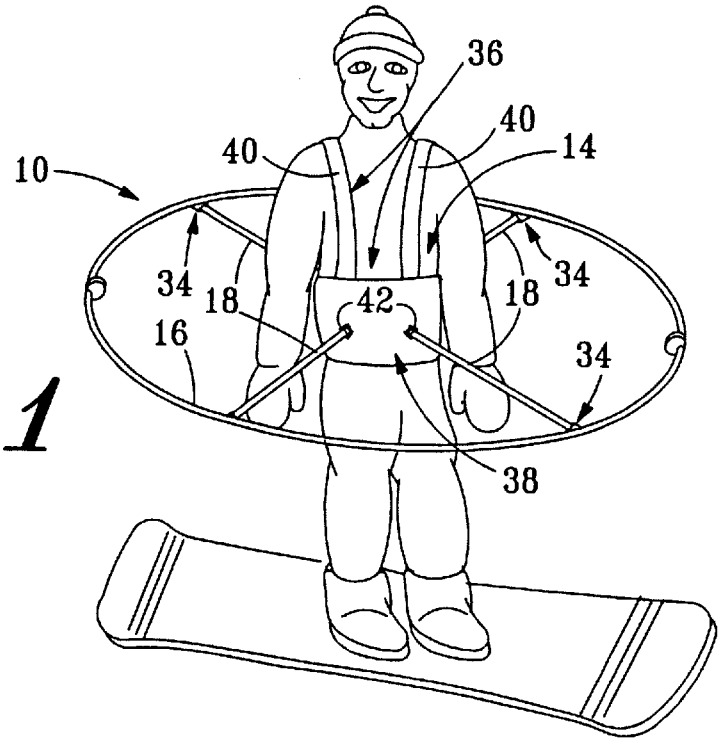
FIG. 1 is a perspective view of a snowboard training device having features of the invention shown as it is typically worn by a trainee.

The following discussion describes in detail one embodiment of the invention and several variations of that embodiment. This discussion should not be construed, however, as limiting the invention to those particular embodiments. Practitioners skilled in the art will recognize numerous other embodiments as well.

The invention is a snowboard training device 10 adapted to enable an instructor to direct the movement of a snowboard trainee from a substantial distance. The snowboard training device 10 comprises an inner member 12 suitable for attaching firmly to the mid-section of the trainee 14, a rigid outer member 16 disposed spaced apart from the mid-section of the trainee 14 at a distance not less than about 12 inches from the mid-section of the trainee 14, and at least one connecting member 18 which acts to fixedly attach the inner member 12 to the outer member 16 in a horizontal disposition.

In the embodiment illustrated in the drawings, the outer member 16 is comprised of a substantially elliptical hoop 20 which encircles the mid-section of the trainee 14. The outer member 16 may, however, be comprised of a substantially circular hoop, a substantially rectangular frame having rounded comers, or other structures, including those not necessarily completely surrounding the mid-section of the trainee 14 but which are capable of fixedly attaching to the inner member 12. Typically the outer member 16 is comprised of a metal or plastic material, but the outer member 16 may also be formed from other sufficiently rigid materials.

Figure 3:
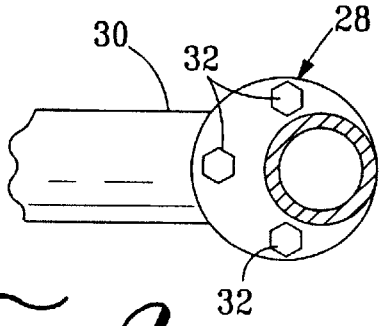
FIG. 3 is a cross-sectional side view of the snowboard training device illustrated in FIG. 2 taken along line 3—3.

Referring to the embodiment illustrated in the drawings, where the outer member 16 is a substantially elliptical hoop 20, the substantially elliptical hoop 20 can be formed from connecting two semi-elliptical pieces 22 together at the major axis 24 of the substantially elliptical hoop 20 (the major axis 24 being the longer axis of an ellipse, and the minor axis 26 being the shorter of the two axis). As illustrated in FIG. 3, the semi-elliptical pieces 22 can comprise flanges 28 at the semi-elliptical termini 30. The flanges 28 provide planar surfaces which abut each other when two semi-elliptical pieces 22 are placed together to form a complete substantially elliptical hoop 20. The flanges 28 are circular and extend inwardly from the inner circumference of each semi-elliptical terminus 30. As diagramed in FIG. 3, each flange 28 in this embodiment has a plurality of flange holes 32 configured such that the flange holes 32 are aligned when two semi-elliptical pieces 22 are placed together. Openings are thus defined which are suitable for the placement of a bolt, screw, pin or other attachment member. This embodiment of the invention allows the outer member 16 to be folded upon itself to become more compact when the snowboard training device 10 is not in use; thus facilitating the storage and transportation capabilities of the snowboard training device 10.

Figure 2:
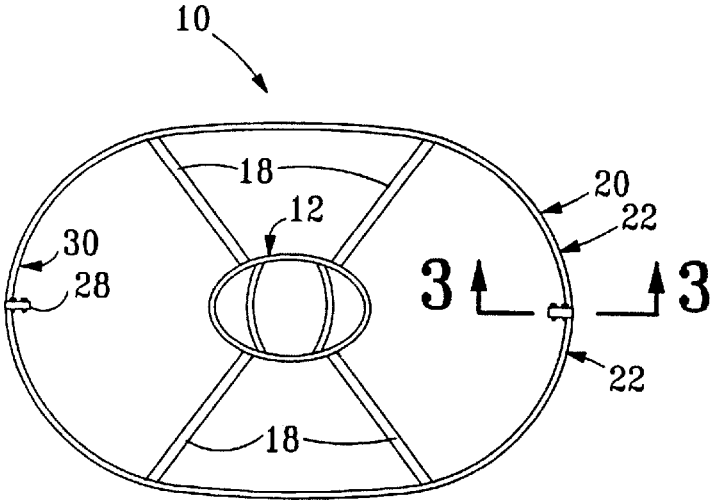
FIG. 2 is a top view of the snowboard training device illustrated in FIG. 1.

In the embodiment illustrated in the drawings, the substantially elliptical hoop 20 is rotationally disposed about the mid-section of the trainee 14 such that the major axis 24 of the substantially elliptical hoop 20 is roughly parallel with the longitudinal axis of the snowboard when the trainee appropriately mounts the snowboard. The length of the major axis 24 of the substantially elliptical hoop 20 shown in FIG. 2 is typically between about 60 inches and about 84 inches. This distance approximates the length of a snowboard. The length of the minor axis 26 of the substantially elliptical hoop 20 shown in FIG. 2 is typically between about 36 inches and about 60 inches. A substantially elliptical hoop 20 having a major axis 24 of about 72 inches and a minor axis 26 of about 48 inches can be used.

In a further preferred embodiment of the invention the outer member 16 has at least one outer member connecting element 34 suitable for connecting with the at least one connecting member 18. The at least one outer member connecting element 34 is preferably disposed on the outer member 16 such that it is directly facing the inner member 12. In the embodiment diagramed in FIG. 1, the substantially elliptical hoop 20 has outer member connecting elements 34 located on the inner surface of the substantially elliptical hoop 20. Each outer member connecting let element 34 is capable of being attached to one end of a connecting member 18, with the other end of the connecting member 18 being attached to the inner member 12. The at least one outer member connecting element 34 may be comprised of sockets, rings, hooks, fasteners, or any other device suitable for attaching to a connecting member 18. In the embodiment of the invention illustrated in FIG. 1, there are four outer member connecting elements 34 distributed about the circumference of the inner surface of the substantially elliptical hoop 20. This embodiment likewise has four connecting members 18.

As illustrated in FIG. 1, the inner member 12 can comprise a harness 36 having a belt 38 encircling the mid-section of the trainee 14 and two shoulder straps 40 which attach to the belt 38 and enable the harness 36 to firmly attach to the mid-section of a trainee 14. In this embodiment, it is preferable that the belt 38 and shoulder straps 40 have adjustment means so that the harness 36 is capable of firmly and comfortably accommodating trainee's having different height and weights. Further preferable, the belt 38 of the harness 36 has at least one harness attachment element 42 located on the outer surface of the belt 38 such that it protrudes outward from the mid-section of the trainee 14 and is suitable for attaching to one end of a connecting member 18. Typically there is one harness attachment element 42 for every one connecting member 18.

The at least one connecting member 18 is disposed between the inner member 12 and the outer member 16. The at least one connecting member 18 can comprise a strap, cord, cable, chain, rod, pole, or sheet-like member. Preferably each of the connecting members 18 are disposed such that they are coplanar in a horizontal plane which is defined by the outer member 16. Further preferable, there are between two and six connecting members 18. In the embodiment illustrated in FIGS. 1 and 2, there are four connecting members 18 which are positioned radially apart from each other at approximately 90 degree angles about the mid-section of the trainee 14. In the embodiment illustrated in FIGS. 1 and 2, the four connecting members 18 can be leather straps.

In operation, a trainee positioned on a snow slope attaches the snowboard training device 10 about the mid-section of the trainee 14. The outer member 16 is supported in a horizontal disposition about the mid-section of the trainee 14 by direct attachment to the connecting members 18 and indirect attachment to the inner member 12. This attachment is relatively inflexible so that forces placed upon the outer member 16 are translated to the inner member 12 through the connecting members 18. The outer member 18 is disposed about the mid-section of a trainee 14 at a substantial distance from the mid-section of the trainee 14. At least one person capable of instructing the trainee accompanies the trainee on a snow slope while the trainee is attempting to independently snowboard. The snowboard training 10 device allows a person instructing the trainee to hold and move the outer member 16 while the trainee is attempting to independently snowboard on a snow slope. The person instructing the trainee is thus able to physically direct the body movements of the snowboard trainee by moving and exerting force upon the outer member 16 of the snowboard training device 10. Typically the outer member 16 comprises a substantially elliptical hoop 20 and the inner member 12 comprises of a harness 36.

What is claimed is:

1. A snowboard training device adapted to enable an instructor to direct the movement of a snowboard trainee from a substantial distance, the snowboard training device comprising an inner member suitable for attaching firmly to the mid-section of the trainee, a rigid outer member disposed spaced apart from the mid-section of the trainee at a distance not less than about 12 inches from the mid-section of the trainee, and at least one connecting member which acts to fixedly attach the inner member to the outer member in a horizontal disposition.

2. The snowboard training device of claim 1 wherein the outer member is substantially elliptical such that it is capable of completely surrounding the mid-section of the trainee.

3. The snowboard training device of claim 2 wherein the outer member is a substantially elliptical hoop.

4. The snowboard training device of claim 1 wherein the outer member is a substantially circular hoop.

5. The snowboard training device of claim 1 wherein the inner member comprises a belt.

6. The snowboard training device of claim 1 wherein the inner member comprises a harness having a belt attached to shoulder straps.

7. The harness of claim 6 wherein the belt and shoulder straps have adjustment means.

8. The snowboard training device of claim 6 wherein the harness has at least one harness attachment element suitable for attaching to the at least one connecting member.

9. The snowboard training device of claim 8 wherein the at least one harness attachment element is a harness ring.

10. The snowboard training device of claim 1 wherein there are between two and six connecting members.

11. The snowboard training device of claim 10 wherein the connecting members are comprised of straps.

12. The snowboard training device of claim 11 wherein the number of straps is four.

13. The snowboard training device of claim 1 wherein the at least one connecting member is comprised of a strap.

14. The snowboard training device of claim 1 wherein the outer member has at least one outer member connecting element suitable for attaching to the at least one connecting member.

15. The snowboard training device of claim 1 wherein the inner member and the outer member are substantially coplanar when the snowboard training device is attached to a trainee.

16. A snowboard training device adapted to enable an instructor to direct the movement of a snowboard trainee from a substantial distance, the snowboard training device comprising:

(a) a substantially elliptical hoop that completely surrounds the mid-section of the trainee;

(b) a harness comprised of a belt connected to a pair of shoulder straps;

(c) a plurality of harness rings connected to said belt;

(d) a plurality of hoop rings connected to said elliptical hoop; and (e) a plurality of straps wherein each strap attaches to a harness ring at one end and one said hoop ring at the opposite end such that said elliptical hoop is held substantially coplanar to said belt when the snowboard training device is attached to a trainee.

17. The snowboard training device of claim 16, wherein:

(a) the plurality of harness rings is comprised of four harness rings;

(b) the plurality of hoop rings is comprised of four hoop rings; and (c) the plurality of straps is comprised of four straps.

18. A method of instructing a trainee to ride a snowboard, the method comprising the steps of:

(a) attaching a snowboard training device to a trainee, the snowboard training device comprising an inner member suitable for attaching firmly to the mid-section of the trainee, a rigid outer member disposed spaced apart from the mid-section of the trainee at a distance not less than about 12 inches from the mid-section of the trainee, and at least one connecting member which acts to fixedly attach the inner member to the outer member in a horizontal disposition;

(b) positioning the trainee on a snowboard on a slope;

(c) accompanying the trainee on the ski slope at a distance suitable to hold the outer member of the of the snowboard training device; and (d) directing the movements of the trainee by exerting force upon the outer member of the snowboard training device.

19. The method of claim 18, wherein the outer member is a substantially elliptical hoop.

20. The method of claim 18, wherein the inner member comprises a harness.

* * * * *